United States Patent [19]

Höfer et al.

[11] 4,083,662

[45] Apr. 11, 1978

[54] FUEL INJECTION PUMP FOR INTERNAL COMBUSTION ENGINE

[75] Inventors: Gerald Höfer, Weissach-Flacht; Karl Konrath, Ludwigsburg; Otmar Weiss, Stuttgart, all of Germany

[73] Assignee: Robert Bosch GmbH, Stuttgart, Germany

[21] Appl. No.: 688,720

[22] Filed: May 21, 1976

[30] Foreign Application Priority Data

May 21, 1975 Germany ..... 2522374

[51] Int. Cl.[2] ..... F04B 39/10

[52] U.S. Cl. ..... 417/499; 123/139 AD

[58] Field of Search ..... 123/139 BD, 139 AB, 123/139 AD, 139 AE, 135 AR; 417/289, 293, 494, 499

[56] References Cited

U.S. PATENT DOCUMENTS

| | | | |
|---|---|---|---|
| 2,746,443 | 5/1956 | Meyer | 123/139 BD |
| 2,813,523 | 11/1957 | Bischoff | 123/139 BD |
| 3,737,258 | 6/1973 | Krauja et al. | 417/499 |
| 3,827,832 | 8/1974 | Faupel | 123/139 AD X |
| 3,942,914 | 3/1976 | Hofer et al. | 123/139 BD X |

*Primary Examiner*—Charles J. Myhre
*Assistant Examiner*—Tony M. Argenbright
*Attorney, Agent, or Firm*—Edwin E. Greigg

[57] ABSTRACT

A fuel injection pump for internal combustion engines having a pump piston reciprocating in a cylinder to inject fuel from a working chamber into the engine cylinders and in which the termination of each injection is determined by an engine r.p.m. device which opens, or partially opens, a relief bore connected between the working chamber and a pump suction chamber. The outlets of the relief bore located on the surface of the pump piston are so formed so as to cooperate with the r.p.m. responsive device to match the injection requirements of the internal combustion engine. Several embodiments of the formed outlets are disclosed.

7 Claims, 8 Drawing Figures

FUEL INJECTION PUMP FOR INTERNAL COMBUSTION ENGINE

BACKGROUND OF THE INVENTION

This invention relates to a fuel injection pump for internal combustion engines having at least one rotating pump piston reciprocating in a cylinder and having a channel which connects the working chamber of the pump with a low pressure chamber and which channel terminates in an outlet opening on the surface of the piston; the amount of opening being controlled by an r.p.m. responsive device having a control edge shiftable axially on the piston. The amount of fuel injected into the engine is thus determined by changing the terminal portion of the fuel delivery during each pressure stroke of the pump piston.

In order to maximize the injection characteristics of the pump relative to the needs of the combustion engine, a relatively large expenditure has hereto been used in achieving this purpose. For example, in a known different type of pump where a channel connecting the working chamber of the pump with a low pressure chamber branches off in the cylinder wall instead of within the pump piston, it is known to enlarge the outlet bore in order to achieve this control of the injection characteristic. However, such an enlargement on the outlet bore of the cylindrical wall is very expensive, since processing tools for this purpose must be introduced into the cylinder.

OBJECT AND SUMMARY OF THE INVENTION

It is an object of this invention to adapt the injection characteristics of the fuel injection pump to the requirements of the internal combustion engine in a more simple and inexpensive manner and especially in a manner suitable for mass production techniques.

Briefly stated, according to the invention, the problem of adapting the terminal portion of the injected fuel to the requirements of the internal combustion engine in the most simple and inexpensive manner is solved by forming the outlets of the relief bore on the piston pump so as to be enlarged, or extended, in a direction axially of the piston pump. Such a formation is relatively simple since it can be accomplished directly on the piston surface itself perferably by an electro-etching process.

One of the advantages in practicing this invention is that the low pressure outlet itself is so formed to control or influence the termination of the injection with the beginning of the injection process remaining uninfluenced. This is different from the known arrangement where the enlargement of the outlet is disposed in the cylinder wall of the pump, since such an enlargement also affects the beginning of the injection, and with increasing speeds, the enlargement would have less effect on the terminal portion of the injection. On the other hand, in this invention, more control is directed to the termination of the injection, without affecting the beginning of the injection, and such control will be more responsive to speed. Finally, to adapt the invention to the needs of individual engines, the individual formations on outlet bores can be triangular or rectangular or any other form, depending upon the need of the engine cylinders.

Other embodiments of the invention will suggest themselves after a study of the following drawings and description wherein:

DESCRIPTION OF THE PREFERRED EMBODIMENT

Figure 1:
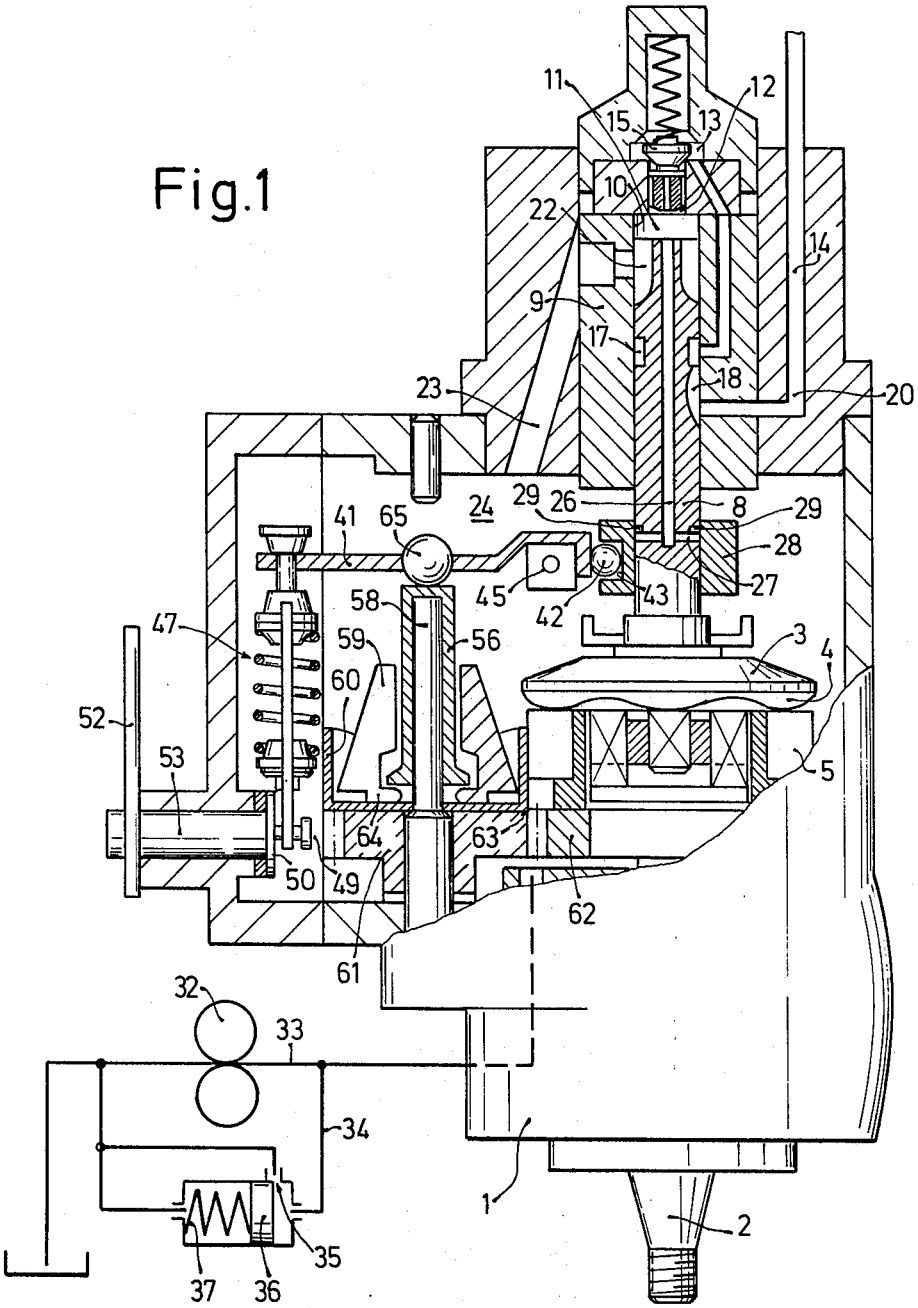
FIG. 1 is a partial sectional view through a distributor type fuel injection pump and showing the single rotating and reciprocating pump piston incorporating the means for controlling the quantity of fuel delivered in accordance with the teachings of the invention.

The disposition of parts and the method of operation of the regulator according to the present invention is described below using the example of a distribution pump of known construction. A housing 1 of a fuel injection pump for multi-cylinder internal combustion engines contains a drive shaft 2. This drive shaft 2 is coupled to a frontal cam plate 3 which has as many cams 4 as the number of cylinders of the associated internal combustion engine. The cam plate 3 is moved by locally fixed rollers 5 and by the rotation of the drive shaft 2. This motion results in a reciprocating and simultaneously rotating motion of a pump piston 8 coupled with the frontal cam plate 3 and pressed onto the cam plate 3 by a spring (not shown). The pump piston 8 is displaceable within a cylindrical bushing 9 which is closed on top and is inserted into the housing 1. The bushing 9 is provided with a cylinder bore 10 which encloses a working chamber 11. From the working chamber 11, an axial bore 12 communicates with a chamber 13 which, in turn, communicates through a line 14 with the bore 10 of the cylinder bushing 9. The axial bore 12 can be closed by a valve member 15 loaded in the direction of the working chamber 11. The connecting line 14 can be connected in sequence with pressure lines 20 terminating in the bore 10 through an annular groove 17 on the periphery of the pump piston 8 and through an axially oriented distributor groove 18 which is connected thereto. The pressure lines 20 are evenly distributed about the cylinder bore 10 and correspond to the number of cylinders of the internal combustion engine to be supplied with fuel. At each pressure stroke of the pump piston 8, fuel is delivered through the axial bore 12, the chamber 13, the connecting line 14 and the distributor groove 18 to one of the pressure lines 20. During the suction stroke, fuel flows from a low pressure chamber 24 through a supply line 23 terminating in the bore 10 and through one longitudinal groove 22 of a plurality of such grooves into the working chamber 11. The grooves 22 are equal in number to the number of cylinders of the engine and are similarly configured on the periphery of the pump piston. During the suction stroke of the pump piston 8, the rotation thereof interrupts the connection between the supply line 23 and the longitudinal grooves 22, so that the entire fuel quantity delivered by the pump piston can be supplied to the pressure lines.

For the purpose of regulating the delivered fuel quantity, the working chamber 11 can be connected with the pump low pressure chamber 24 through an axial blind bore 26 in the pump piston 8 and further through a transverse bore 27 intersecting the blind bore 26. Cooperating with the transverse bore 27 is a fuel quantity setting member 28 in the form of a sleeve slidable on the pump piston 8, where the position of the sleeve determines the point in time at which the upward motion of the pump piston 8 opens the transverse bore 27 and creates a connection between the working chamber 11 and the pump suction chamber 24. From this point on, the pump delivery is interrupted. Thus, the displacement of the sleeve 28 can be used to determine the quantity of fuel which is supplied for injection.

The supply of fuel to the pump working chamber is affected by a fuel pump 32 which aspirates fuel from a supply reservoir 31 through a supply channel 33 into the low pressure chamber 24. In order to obtain an r.p.m. dependent pressure, a bypass of the fuel pump 32 contains a connecting line 34 with a throttle location 35. The size of the throttle opening can be changed by a piston 36 whose rear face is actuated by a spring 37 and also by the fuel pressure prevailing at the suction side of the pump, and whose front suface is actuated by the fuel pressure prevailing in the supply channel 33.

The change in the injected fuel quantity is effected by setting the sleeve 28 by means of a control lever 41 whose special head 42 engages a recess 43 within the sleeve 28. The control lever 41 is mounted on a shaft 45 serving as a fixed pivotal point. The position of this shaft can be changed by means which are not shown, for example, by an eccentric means in order to obtain a basic setting. Fastened to the extreme opposite end of the control lever 41 is a control spring mechanism 47. The other end of the control spring mechanism connects via a connecting bolt 49 with a setting lever 50 which is rigidly mounted on an actuating shaft 53. The shaft 53 passes through a sealed bore 51. The shaft 53 can be externally rotated by a further lever 52, fixedly disposed thereon.

Located between the fastening point of the control spring mechanism 47 and the shaft 45 is the point of contact of a centrifugal force governor sleeve 56 which is slidingly displaced by fly weights 59 on a governor shaft 58. The fly weights 59 are located in sheet metal pockets 60 fixedly mounted on a gear 61 carried by the governor axis. The gear 61 is driven by a drive gear 63 rigidly connected with the drive shaft 2, and the fly weights 59 are driven by the sheet metal pockets 60 which, in turn, are driven by the gear 61. The fly weights 59 are moved radially outward corresponding to the r.p.m. and their protruding noseshaped parts 64 lift the centrifugal force governor sleeve 56. Thus, when the governor sleeve 56 contacts the control lever 41, the r.p.m.-dependent centrifugal force is transmitted by the lever action to the control lever and against the force of the control spring mechanism 47. In order to keep the distance between the point of contact of the centrifugal force transmitted by the governor sleeve and the shaft 45 constant at all times, this point contains a sphere 65 pressed into the control lever 41.

As soon as the clockwise moment provided by the centrifugal force exceeds the counterclockwise moment due to the control spring mechanism 47, the sleeve 28 is moved downwardly in a direction which reduces the fuel injection quantity. This process takes place until an equilibrium of forces again prevail at the control lever 41.

Figure 2:
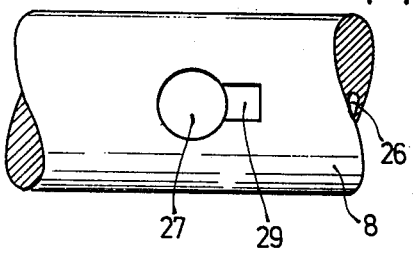
FIGS. 2, 3 and 4 show various embodiments of the extension or enlargements of the outlet of the relief bores.
Figure 3:
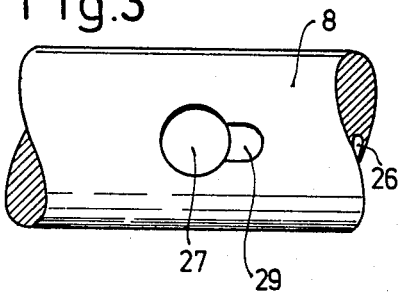
Figure 4:
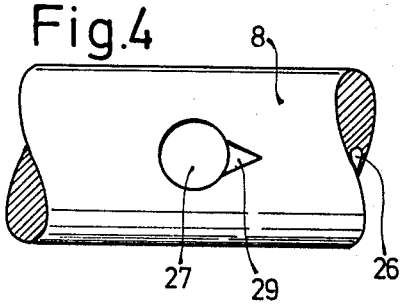

As shown in FIGS. 2, 3 and 4, which are enlarged scale partial views of the pump piston 8, the enlargement or extension 29 of the transverse of that bore 27 is shown formed in different configurations, i.e., rectangular, semicircular, triangular and may be formed in any other cross-section, not illustrated, within the understanding of those skilled in the art.

This enlargement or extension 29 is formed on the pump piston by an electro-etching process, and as can be appreciated, one can achieve the control of the termination and thus the amount of fuel injected by the relationship between the extension 29 and the control edge of the sleeve 28. This extension and its relationship with a portion of the control edge of the sleeve, is affected by speed, and, in the case of high r.p.m.'s, the throttling effect of this extension is considerably greater than at low speeds; an effect which is desirable. The shape of the enlargement also has an effect on the characteristics of the injection, namely, in the case of a rectangular cross-section, such as shown in FIG. 2, it has been found that the increasing movement of the piston relative to the control edge of the sleeve causes a linear variation in cross-section of the opening, whereas in the case of the embodiments of FIGS. 3 and 4, the relationship of the termination of the fuel is different. In the case of FIGS. 3 and 4, the cross-sectional surface increases with the stroke as a square function. These functional characteristics, however, can change, depending upon r.p.m., so that many variations in the shape of the enlargements suggest themselves.

As hereinabove stated, the different effects are utilized in order to achieve a maximization of the conveyed or injected quantity of fuel to meet the ideal requirement of the engine. Thus, if it is desired that the injection pump at low speeds convey a lower quantity of fuel, these extensions are adapted especially well to meet this requirement, yet be able to deliver a higher quantity of fuel in case of higher speed. In the case of lower speeds, the throttling effect of the extension 29 relative to the upward movement of the sleeve 28 is not critical because the sleeve will be positioned in such a manner that the injection is terminated immediately. Yet in the case of higher speeds, with the same position of sleeve 28, the throttling effect of the extension 29 causes a termination of the fuel only after completion of a somewhat larger stroke. Thus, utilizing the teachings of this ivention and accordingly shaping of the extension 29, there is in reality a secondary termination effect at higher r.p.m.'s not heretofore possible at a low cost. In prior fuel injection pumps, limiting the amount of fuel at low speeds without at the same time increasing the amount delivered at higher speeds, could only be done at considerable expense.

Figure 5:
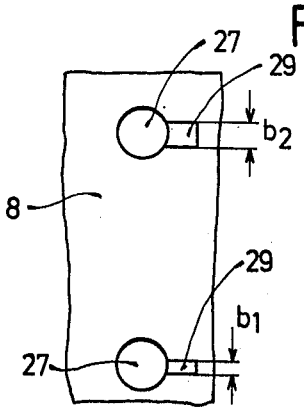
Figure 6:
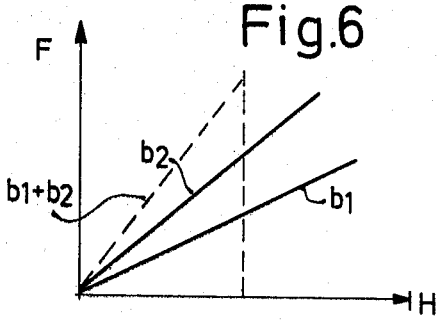

FIG. 5 shows a layout of the suface of the piston in order to show both outlets of the transverse bore 27 with extensions 29. In this figure, the enlargement 29 shown at the top is wider than one shown below and, in the diagram shown in FIG. 6, the characteristic lines of these two enlargements are shown. In this diagram, the cross-section F of the enlargement 29 (ordinate) is shown relative to upward control stroke H (abscissa) of the piston. The curve *b*1 corresponds to the narrower enlargement, the curve *b*2 corresponds to the wider enlargement, and the entire crosssectional area of opening can then be deduced from the curve *b*1 + *b*2 which is developed by adding *b*1 and *b*2 as shown in the drawing.

Figure 7:
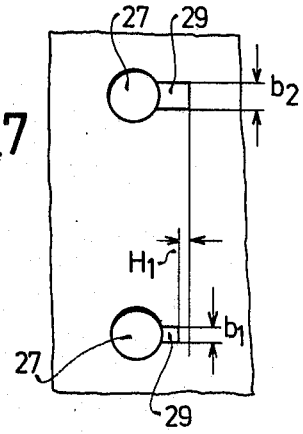
FIGS. 5 and 7 show embodiments of the invention of unequal sizes.
Figure 8:
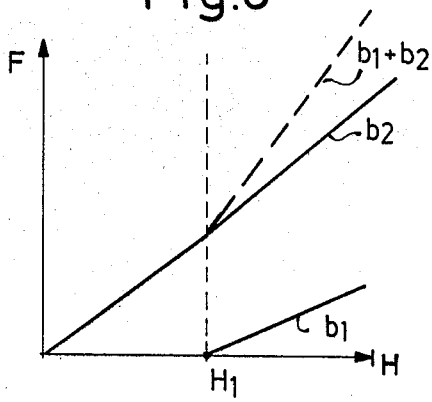
FIGS. 6 and 8 show diagrams corresponding to the amount of opening of the formations relative to the control edge of the sleeve.

In the case of the layout as shown in FIG. 7, a still further variation of these enlargements 29 is shown. Instead of merely making the width of the enlargement 29 different as in FIG. 5, in this case the length too is different with an opening corresponding to the stroke of the piston at H1. As can be seen from the diagram shown in FIG. 8, which corresponds to the diagram of FIG. 6, the lines *b2*, i.e., the upper enlargement 29 as shown in FIG. 7, starts only at point H1. By adding the characteristic lines *b1* and *b2*, there results an angle after point H1 where *b1* opens. Thus, upward control curve *b1* + *b2* is deduced by adding *b1* only after H1 is reached.

Up to point H1, the speed has a particularly strong effect in the throttling action of opening *b2* but after point H1 on the basis of the greatly increased crosssection, speed has less effect. Thus, depending upon how these enlargements are shaped, for example, triangularly, semicircularly, etc., the speed will have a variable effect on throttling action of the openings and thus on the quantity of control delivered to the engine.

Finally, the advantage of this invention being formed on the surface of the pump piston, also consists in the fact that when the piston element has been completed, these formations can be specifically adapted to the particular engine. No prior shaping is required but the configuration of the formation can be worked into the particular piston at the time of mounting the pump on the engine.

What is claimed is:

1. In a fuel injection pump for internal combustion engines including: means defining a cylinder, an operating chamber and a low pressure chamber, a pump piston situated for reciprocating movement within the cylinder, the pump piston having a bore formed therein with a radial portion defining two openings in the wall of the pump piston, said bore connecting the operating chamber to the low pressure chamber; and means defining a control edge for opening and closing the two openings, the improvement comprising:

an enlargement formed at each end of the radial portion of the bore in the pump piston wall and connected to the bore thereby defining an extension of the bore opening, wherein at least one common dimension of each enlargement is different in magnitude, and wherein each enlargement cooperates with the controlling edge to control the amount of fuel injected into the engine on each pressure stroke of the piston.

2. In the fuel injection pump as defined in claim 1, wherein at least two common dimensions of each enlargement are different in magnitude.

3. In the fuel injection pump as defined in claim 1, wherein each enlargement is formed in the pump piston wall on the side of the radial portion of the bore which is adjacent to the working chamber in order to terminate the injection process so that the enlargements influence the end of the injection process.

4. In the fuel injection pump as defined in claim 1, wherein the means defining the control edge comprises an annular slide disposed about the pump piston, the pump further including: a regulator connected to the annular slide for shifting said annular slide relative to the longitudinal axis of the pump piston.

5. In the fuel injection pump as defined in claim 1, wherein the cross sectional shape of each enlargement is rectangular.

6. In the fuel injection pump as defined in claim 1, wherein the cross sectional shape of each enlargement is triangular.

7. A method of forming a piston for a fuel injection pump comprising the steps of:

forming an axial bore in said piston, forming a radial bore in said piston which intersects said axial bore and opens at both ends in the outer wall of the piston so that a flow path through the axial and radial bores and through each opening is established, and forming enlargements in said outer wall at said ends of said radial bore by electro-etching so that at least one common dimension of each enlargement is different in magnitude and in order to match the injection requirements of an internal combustion engine.

* * * * *